US006200523B1

(12) United States Patent
Quick et al.

(10) Patent No.: US 6,200,523 B1
(45) Date of Patent: Mar. 13, 2001

(54) APPARATUS AND METHOD OF SINTERING ELEMENTS BY INFRARED HEATING

(75) Inventors: Nathaniel R. Quick, Lake Mary, FL (US); Tao Li, Newark, DE (US); Robert Malanga, Monroe, CT (US); Michael Liberman; Alexander Sobolevsky, both of Deland, FL (US); James A. McGrath, Winter Park, FL (US)

(73) Assignee: USF Filtration and Separations Group, Inc., Timonium, MD (US)

( * ) Notice: Subject to any disclaimer, the term of this patent is extended or adjusted under 35 U.S.C. 154(b) by 0 days.

(21) Appl. No.: 09/408,748

(22) Filed: Sep. 30, 1999

Related U.S. Application Data

(60) Provisional application No. 60/102,591, filed on Oct. 1, 1998.

(51) Int. Cl.[7] ..... B22F 3/14
(52) U.S. Cl. ..... 419/2; 419/4; 419/48
(58) Field of Search ..... 419/2, 4, 48

(56) References Cited

U.S. PATENT DOCUMENTS 4,517,448 * 5/1985 Crain et al. ..... 219/388
4,642,042 * 2/1987 Smith ..... 425/364 R
4,725,716 * 2/1988 Entwistle et al. ..... 219/388
5,304,330 * 4/1994 Tatarchuk et al. ..... 264/61
5,463,367 * 10/1995 Ellis ..... 338/308
5,665,479 * 9/1997 Vandamme et al. ..... 428/613
5,677,088 * 10/1997 Kobayashi ..... 429/235
5,679,441 * 10/1997 Saelens et al. ..... 428/198
5,717,985 * 2/1998 Labombard et al. ..... 399/249
5,728,490 * 3/1998 Edgington et al. ..... 429/235
5,851,647 * 12/1998 Foster ..... 428/304.4
5,864,119 * 1/1999 Vogt et al. ..... 219/388
6,013,376 * 1/2000 Yenni, Jr. ..... 428/458
6,017,583 * 1/2000 Gass ..... 427/201

* cited by examiner

*Primary Examiner*—Daniel J. Jenkins
(74) *Attorney, Agent, or Firm*—Frijouf, Rust & Pyle, P.A.

(57) ABSTRACT

An apparatus and a method is disclosed for sintering a matrix of elements such as fibers or particles by infrared heating. A multiplicity of the elements are arranged into a matrix of substantially randomly oriented elements to form a web. The web is irradiated with infrared energy for a period of time sufficient to sinter bond each of the elements to adjacent elements of the matrix randomly oriented elements.

29 Claims, 7 Drawing Sheets

APPARATUS AND METHOD OF SINTERING ELEMENTS BY INFRARED HEATING

This application claims priorty to U.S. Provisional Application No. 60/102,591 filed 10/1/1998.

BACKGROUND OF THE INVENTION

1. Field Of The Invention

This invention relates to sintering and more particularly to the process of sintering a matrix of elements such as fibers or particles with electromagnetic radiation such as infrared radiation.

2. Background Of The Invention

Various means and methods have been provided in the past for sintering materials such as ceramic fibers, metallic fibers or powders. In general, these sintering processes included placing a matrix of fibers or the powder into an oven. The oven was raised to temperatures sufficient to at least melt a portion of the surfaces of each of the fibers or the particles of powder of the matrix. Upon the melting of the surfaces of each of the fibers or the particles of powder, the fibers or the particles of powder were sintered into a unitary mass.

In some instances, the sintering process was accomplished within a vacuum, a reactive or a non-reactive atmosphere. In such instances, the sintering process may utilize a vacuum oven or a continuous process oven which is purged with a desired atmospheric gas.

In general, the sintering ovens of the prior art utilized conventional heating elements for heating the walls of the oven. The heated wall of the oven heated the matrix of the fibers or the powder through a convection process. Although the sintering ovens of the prior art have operated satisfactorily, the sintering ovens of the prior art were costly to operate. In addition, the sintering ovens of the prior art required a substantial time to heat up the ovens to an operational temperature as well as a substantial time to cool down from the operational temperature after completion of the sintering process. In a vacuum oven, this time for heating up and cooling down contributes substantially to the overall time required to sinter the material in the vacuum oven.

Therefore, it is an object of this invention to provide an improved apparatus and method of sintering a web of elements which overcomes the problems encountered by the prior art and provides a significant advancement in the pertinent art.

Another object of this invention is to provide an improved apparatus and method of sintering a web of elements incorporating an infrared heating source for sintering the web of elements.

Another object of this invention is to provide an improved apparatus and method of sintering a web of elements wherein the infrared heating source may be used when the sintering material is fixed relative to the infrared heating source.

Another object of this invention is to provide an improved apparatus and method of sintering a web of elements wherein the infrared heating source may be used when the sintering material is moving relative to the infrared heating source.

Another object of this invention is to provide an improved apparatus and method of sintering a web of elements wherein the web of elements is rolled into a compressed web concurrently with the sintering process.

Another object of this invention is to provide an improved apparatus and method of sintering a web of elements which provides for an efficient heat transfer from the infrared heating source to the web of elements.

Another object of this invention is to provide an improved apparatus and method for sintering a web of elements having a low sintering time of two (2) to five (5) minutes.

Another object of this invention is to provide an improved apparatus and method of sintering a web of elements which provides for a more rapid heat up and cool down time.

Another object of this invention is to provide an improved apparatus and method for sintering a web of elements having superior repeatability of process and consistency of sintered properties such as porosity.

Another object of this invention is to provide an improved apparatus and method of sintering a web of elements which allows for more economical operation.

Another object of this invention is to provide an improved apparatus and method of sintering a web of elements which substantially reduces the cost of power for sintering the material.

Another object of this invention is to provide an improved apparatus and method of sintering a web of elements which provides for a cleaner sinter bonded material.

Another object of this invention is to provide an improved apparatus and method for sintering a web of elements which eliminates the need for refractory materials.

Another object of this invention is to provide an improved apparatus and method for sintering a web of elements which eliminates the need for refractory materials and uses a transparent material which does not stick to the sintered web.

Another object of this invention is to provide an improved apparatus and method of sintering a web of elements with a decrease of gas and power consumption.

Another object of this invention is to provide an improved apparatus and method for sintering a web of elements with low capital expenses on equipment.

Another object of this invention is to provide an improved apparatus and method for sintering a web of elements wherein the temperature of the web may be monitored for controlling the output of an infrared source heating the web of elements.

Another object of this invention is to provide an improved apparatus and method for sintering a web of elements wherein the web of elements may be sintered with a predetermined quantity of infrared energy.

Another object of this invention is to provide an improved apparatus and method for sintering a web of elements wherein the web of elements is a composite of metallic fibers and non-metallic particles.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly, other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved apparatus and method for sintering a web of elements. The apparatus and method comprises irradiating the web with infrared energy for a period of time sufficient to sinter bond each of the elements to adjacent elements of the matrix randomly oriented elements.

In a more specific embodiment of the invention, each of the elements of the matrix randomly oriented elements may be a metallic fiber such as a stainless steel fiber. In the alternative, each of the elements of the matrix randomly oriented elements may comprise a plurality of metallic elements and a plurality of non-metallic elements. The plurality of metallic elements may entrap the plurality of non-metallic elements therein.

In one embodiment of the invention, the invention relates to an apparatus and a method of forming a sintered web of elements. The apparatus and method comprises arranging the elements into a matrix randomly oriented elements to form a web and irradiating the web with infrared energy for a period of time sufficient to sinter bond the elements each of the elements to adjacent elements of the matrix randomly oriented elements.

In a more specific embodiment of this invention, the apparatus and method includes the step of rolling the web between a first and a second roller for at least partially compressing the web. This step of irradiating the web may include simultaneously rolling the web between a first and a second roller for at least partially compressing the web and irradiating the web from opposed first and second sides of the web. Furthermore, the step of irradiating the web may include simultaneously rolling the web between a first and a second roller for at least partially compressing the web and irradiating the web from a source of radiation positioned internal the first and second rollers.

In another embodiment of the invention, the step of irradiating the web includes irradiating the web in a vacuum, a reactive atmosphere or a non-reactive atmosphere. In a specific example, of the invention, the web is irradiated in a hydrogen atmosphere.

In still another embodiment of the invention, the step of irradiating the web may include irradiating the web with infrared radiation having a wavelength for preferentially heating the plurality of metallic elements relative to the plurality of non-metallic elements.

In still another embodiment of the invention, the step of irradiating the web may include monitoring the temperature of the web and controlling the output of the infrared radiation for irradiating the web in accordance with a predetermined standard. Preferably, the control of the output of the infrared radiation may produce a sintering diffusion flow in accordance with the Arrhenius formula.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
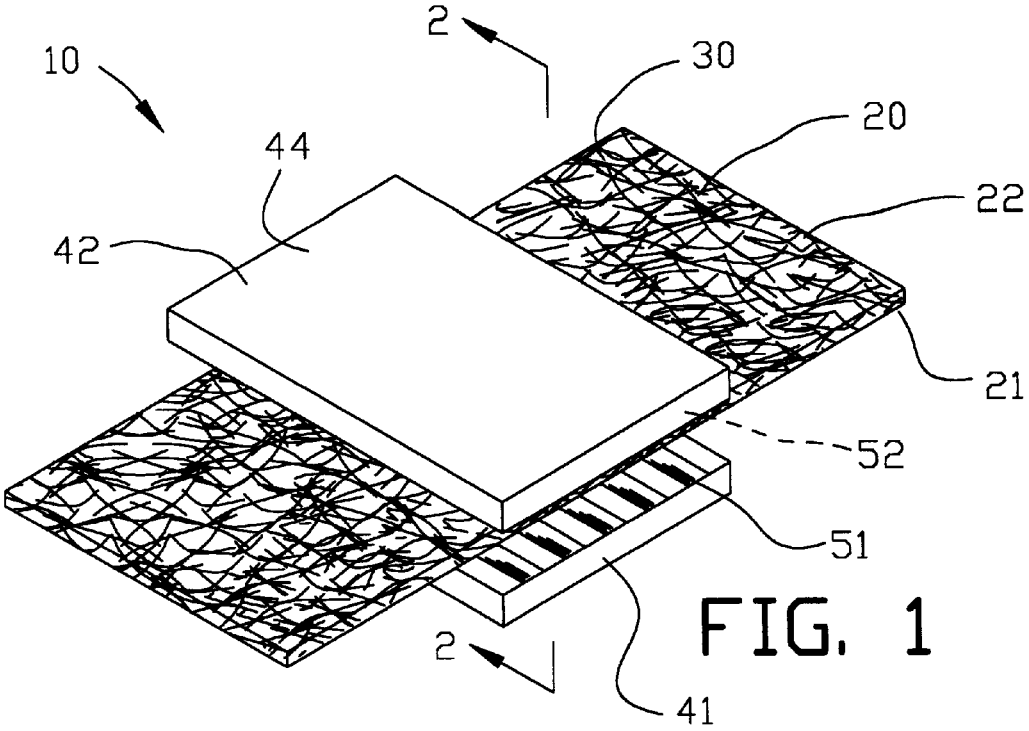
FIG. 1 is an isometric view of a first embodiment of the present invention illustrating an apparatus for sintering a web of randomly oriented elements by irradiating the web.

FIG. 1 is an isometric view of a first apparatus 10 for sintering a web 20 of elements 30 by infrared heating. Each of the elements 30 of the matrix randomly oriented elements 30 may be a metallic fiber such as a stainless steel fiber. In the alternative, the elements 30 of the matrix randomly oriented elements 30 may comprise a plurality of first metallic fibers mixed with a plurality of second metallic fibers.

The web 20 of the elements 30 is defined by a first side 21 and an opposing second side 22. The elements 30 are arranged into a matrix of randomly oriented elements 30 for forming the web 20. Preferably, the web 20 of the elements 30 is compressed prior to entry into the apparatus 10.

The apparatus 10 is suitable for use with either a discrete web 20 or continuous webs 20. In the case of a discrete web 20, the discrete web 20 may be static relative to the apparatus 10 during the sintering process. In the alternative, the web 20 may be moving relative to the apparatus 10 during the sintering process.

In this embodiment of the invention, the apparatus 10 comprises a first and a second housing 41 and 42 for supporting a first and a second light source 51 and 52. Each of the first and second light source 51 and 52 comprise a plurality of infrared lamps 54 and 56. In this example of the invention, the first and second light sources 51 and 52 are capable of emitting electromagnetic radiation having a wavelength greater then 700 nm.

Figure 2:
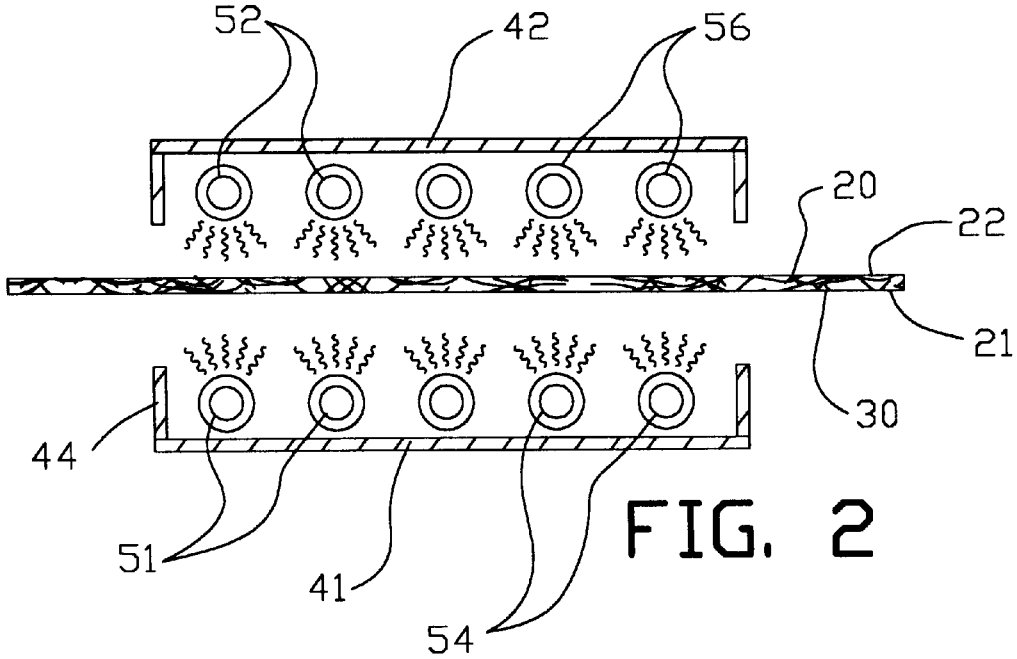
FIG. 2 is an enlarged view along line 2—2 in FIG. 1.

FIG. 2 is an enlarged view along line 2—2 in FIG. 1. Preferably, the first and second housings 41 and 42 are equipped with appropriate seals (not shown) for providing a closure 44 for providing a controlled atmosphere. The first and second light sources 51 and 52 are enclosed within the closure 44 formed by the first and second housings 41 and 42 for providing a controlled atmosphere for the sintering process.

An input and output chamber (not shown) may be provided for maintaining the controlled atmosphere within the closure 44 formed by the first and second housings 41 and 42. In addition, the output chamber (not shown) may provide a cooling chamber for insuring the sintered web 20 is cooled within the controlled atmosphere. The web 20 may be irradiated within a vacuum, a reactive atmosphere or a non-reactive atmosphere. In one example of the process, the web 20 is irradiated within a reducing atmosphere such as hydrogen.

The infrared electromagnetic radiation from the first and second infrared sources 51 and 52 simultaneously irradiate the first and second sides 21 and 22 of the web 20. The speed of the movement of the web 20 and the intensity of the first and second infrared sources 51 and 52 are adjusted to irradiate the web 20 with infrared energy for a period of time sufficient to sinter bond each of the elements 30 to adjacent elements 30 of the matrix randomly oriented elements 30.

The apparatus 10 provides for the rapid heating and cooling of the web 20. The rapid heating and cooling of the web 20 enables the apparatus 10 to be used with either a discrete web 20 or a continuous web 20. Accordingly, the continuous web 20 may be of virtually unlimited length.

During the sintering process, each of the metallic fibers 30 of the matrix of randomly oriented fibers 30 are bonded to adjacent fibers 30 by heating at a temperature below the melting points of the metallic fibers 30. The mechanisms operating during the sintering process include vapor and/or liquid transport, diffusion and plastic flow. The predominant mechanisms operating during the sintering process is diffusion.

Diffusion flow is based on the concept that a certain concentration of vacancies exists in the crystal lattice of the metal fibers 30. The concentration of vacancies exists in the crystal lattice of the metal fibers 30 is a function of temperature in accordance with the well known Arrhenius relationship;

$$D = D_o e^{-\frac{Q}{RT}}$$

where $D_o$ is a pre-exponent constant

Q is the activation energy for self diffusion

R is a molar gas constant

T is absolute temperature

The concentration of vacancies in the crystal lattice of the metal fibers 30 increase as a function of temperature to values approximating 1 in 10,000 positions near the melting point of the metal fibers 30.

The concentration of vacancy in the crystal lattice of the metal fibers 30 is also a function of the chemical potential or stress of the metal surface. Consequently a gradient of vacancies exist between a highly curved convex surface, which has a lower, vacancy concentration, and an adjacent flat surface, which has a lower vacancy concentration. These driving forces expand initial particle contact areas and small necks into large necks to reduce the surface energy of particles.

The infrared sources 51 and 52 irradiate the first and second sides 21 and 22 of the web 20 as a non-contact heat source. The non-contact heat source of the infrared sources 51 and 52 of the present invention provides significant advantages over the convection and conduction heating processes of the prior art.

Figure 3:
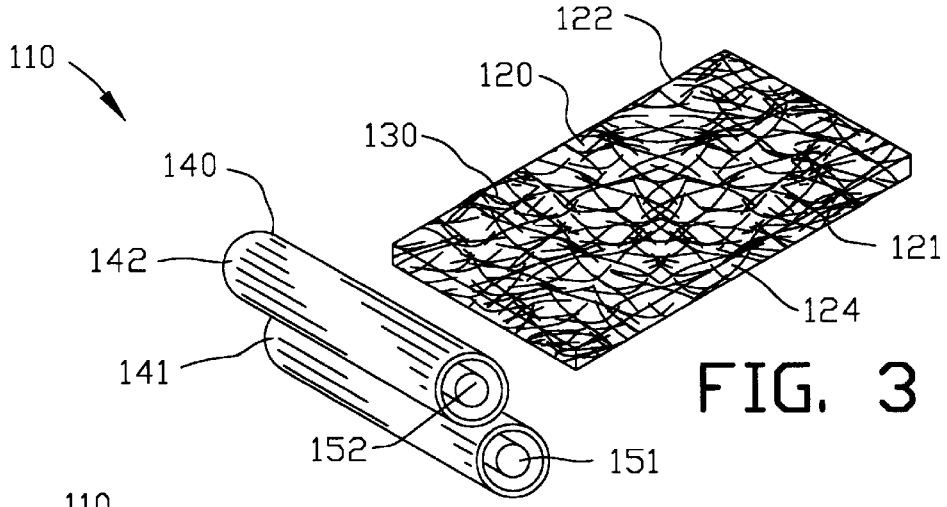
FIG. 3 is an isometric view of a second embodiment of the present invention illustrating an apparatus for simultaneously compressing and sintering a web of randomly oriented elements within the web.

FIG. 3 is an isometric view of a second embodiment of the present invention illustrating an apparatus 110 for simultaneously compressing and sintering a web 120 of randomly oriented elements 130 within the web 120. The web 120 of the elements 130 is defined by a first side 121 and an opposing second side 122. The elements 130 are arranged into a matrix of randomly oriented elements 130 for forming the web 120. In one example, the elements 30 are metallic fibers such as stainless steel fiber or the like.

The apparatus 110 comprises a roller assembly 140 for compressing the web 120. The roller assembly 140 comprises a first and a second roller 141 and 142 for engaging with the first and second sides 121 and 122 of the web 120. The web 120 is shown as an uncompressed portion 124.

A first and a second infrared source 151 and 152 are located respectively within the first and second rollers 141 and 142. Preferably, the first and second infrared sources 151 and 152 emit infrared electromagnetic radiation having a wavelength greater than 700 nm.

The first and second rollers 141 and 142 are fabricated from a material being transparent to the infrared electromagnetic radiation of the first and second infrared sources 151 and 152. Since the first and second rollers 141 and 142 are transparent to the infrared electromagnetic radiation of the first and second infrared sources 151 and 152, the first and second rollers 141 and 142 absorb a minimum amount of heat. Several examples of material suitable for fabricating the first and second rollers 141 and 142 include quartz, silicon carbide as well as various ceramic materials.

Figure 4:
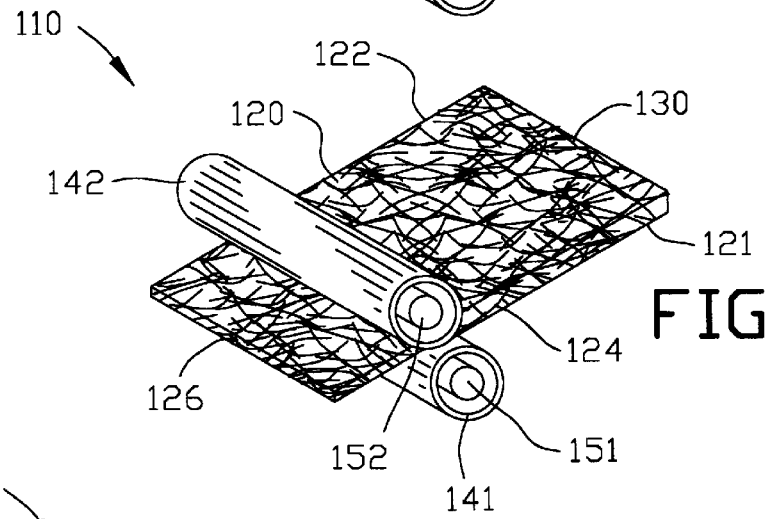
FIG. 4 is an isometric view of the apparatus of FIG. 3 illustrating the simultaneous compression and sintering of the web by irradiating the web.

FIG. 4 is an isometric view of the apparatus 110 of FIG. 3 illustrating the simultaneous compression and sintering of the web 120 by irradiating the web 120. The web 120 is rolled between the first and second rollers 141 and 142 for at least partially compressing the web 120. The first and second rollers 141 and 142 compress the web 120 from an uncompressed portion 124 of the web 120 to a compressed portion 126 of the web 120 upon rotation of the first and second rollers 141 and 142. The compressed portion 126 of the web 120 has a reduced thickness relative to the uncompressed portion 124 of the web 120.

Concurrently therewith, the infrared electromagnetic radiation from the first and second infrared sources 151 and 152 is transmitted through the first and second rollers 141 and 142 for simultaneously irradiating the first and second sides 121 and 122 of the web 120.

The rotational speed of the first and second rollers 141 and 142 and the intensity of the first and second infrared sources 151 and 152 are adjusted to irradiate the web 120 with infrared energy for a period of time sufficient to sinter bond each of the elements 130 to adjacent elements 130 of the matrix randomly oriented elements 130.

Preferably, the irradiating of the web 120 is accomplished in a controlled atmosphere. The first and second rollers 141 and 142 may be enclosed for providing a controlled atmosphere for the sintering process. The web 120 may be irradiated within a vacuum, a reactive atmosphere or a non-reactive atmosphere. In one example of the process, the web 120 is irradiated within a reducing atmosphere such as hydrogen.

Figure 5:
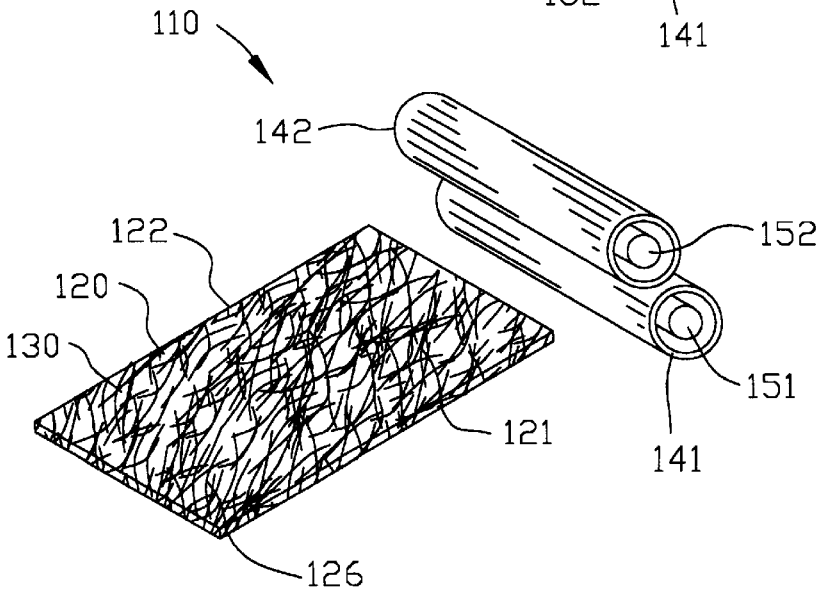
FIG. 5 is an isometric view of the sintered elements being discharged from the apparatus of FIGS. 3 and 4.

FIG. 5 is an isometric view of the sintered elements 130 being discharged from the apparatus 110 of FIGS. 3 and 4. The sintered elements 130 rapidly cools after being discharged from the apparatus 110.

Figure 6:
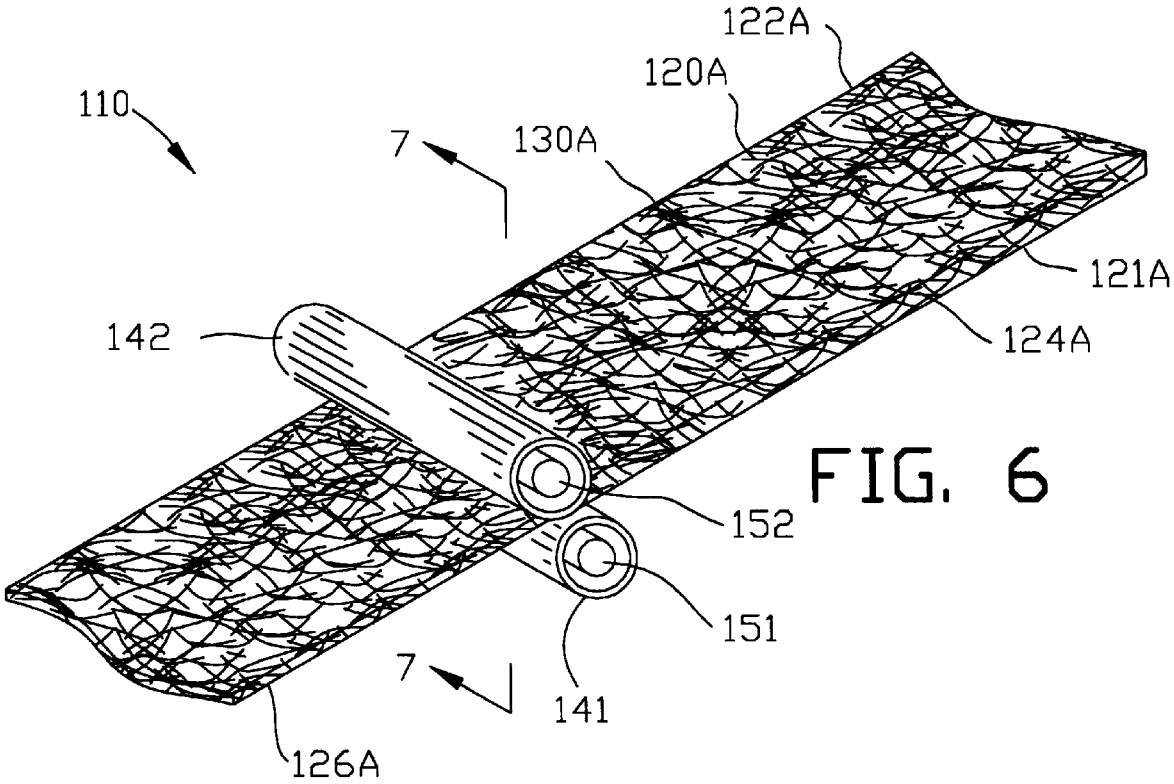
FIG. 6 is an isometric view of the apparatus of FIG. 3 illustrating the simultaneous rolling and sintering of a continuous web.

FIG. 6 is an isometric view of the apparatus 110 of FIGS. 3–5 illustrating the simultaneous compression and sintering of a continuous web 120A. The web 120A of the elements 130A is defined by a first side 121A and an opposing second side 122A.

Since the apparatus 110 provides for the rapid heating and cooling of the web 120A, the apparatus 110 is suitable for use with a continuous web 120A. Accordingly, the continuous web 120A may be of virtually unlimited length.

Figure 7:
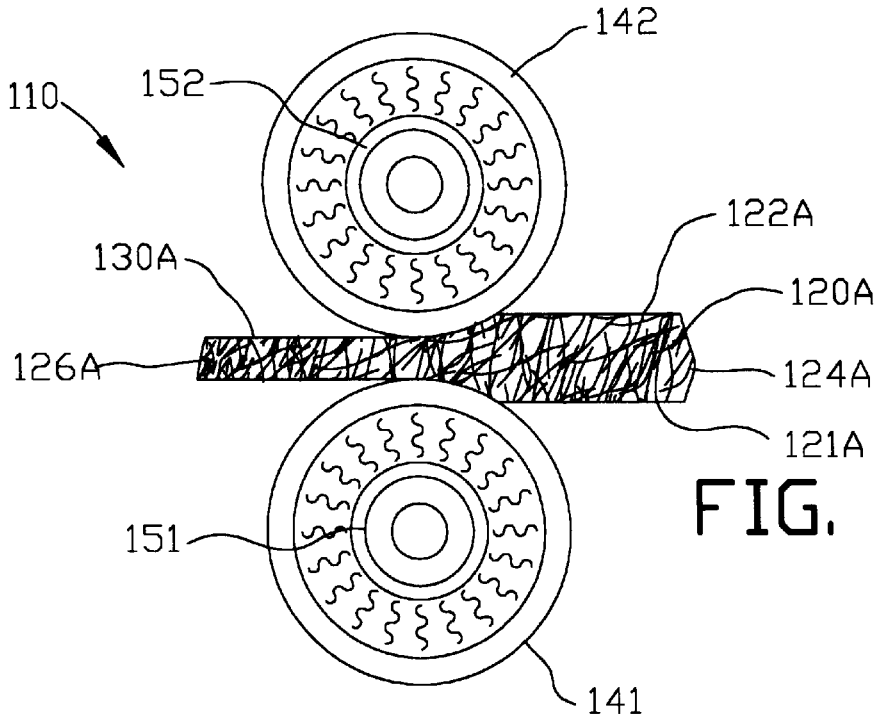
FIG. 7 is an enlarged view along line 7—7 in FIG. 6.

FIG. 7 is an enlarged view along line 7—7 in FIG. 6. FIG. 7 illustrates the compressed portion 126A of the web 120A relative to the uncompressed portion 124A of the web 120A. The infrared electromagnetic radiation from the first and second infrared sources 151 and 152 is transmitted through the first and second rollers 141 and 142 for simultaneously irradiating the first and second sides 121A and 122A of the web 120A during the compression process.

FIGS. 8–15 are isometric views of a third embodiment of the present invention illustrating an apparatus 210 for simultaneously compressing and sintering a web 220 of randomly oriented elements 230 within the web 220.

Figure 8:
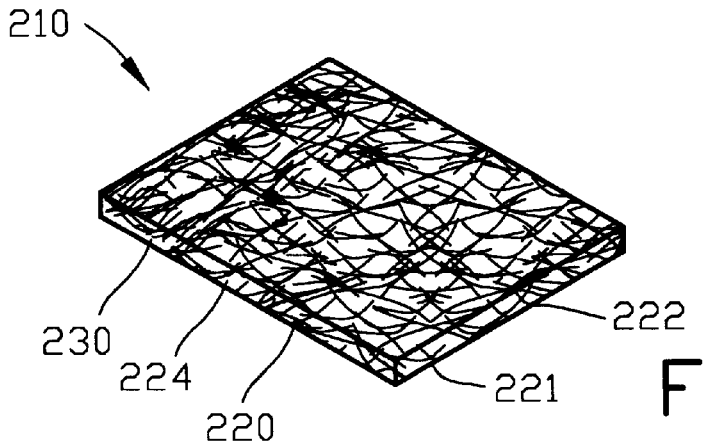
FIG. 8 is an isometric view of a third embodiment of the present invention illustrating an apparatus for simultaneously compressing and sintering a web of randomly oriented elements within the web.

FIG. 8 is an isometric view of a web 220 of the elements 230 defining a first side 221 and an opposing second side 222. The elements 230 are arranged into a matrix of randomly oriented elements 230 for forming the web 220. The web 220 is shown as an uncompressed portion 224.

Figure 9:
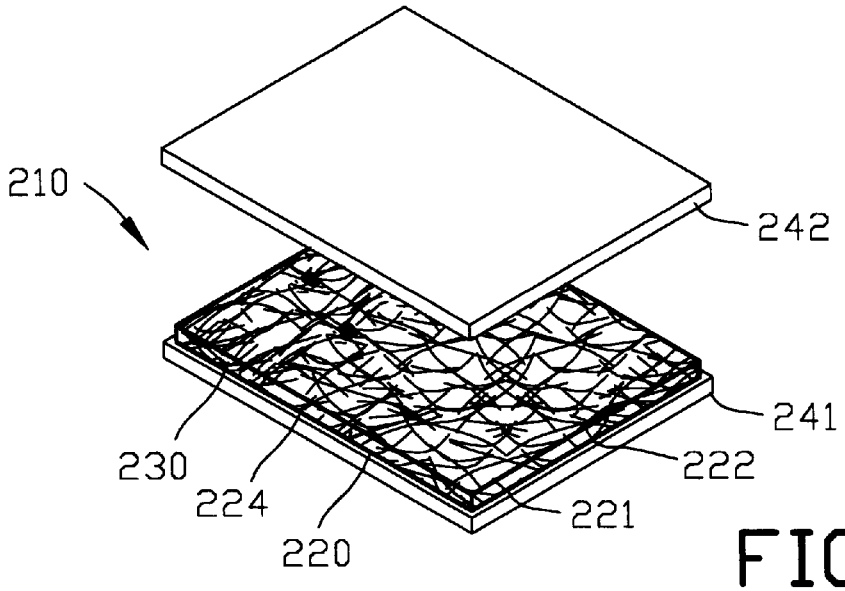
FIG. 9 is an isometric view of the apparatus of FIG. 8 illustrating the web placed upon a transparent support sheet.

FIG. 9 is an isometric view of the apparatus 210 of FIG. 8 illustrating the web 220 placed upon a transparent support sheet 241. The transparent support sheet 241 is fabricated from a material being transparent to the infrared electromagnetic radiation of the first infrared source 251. The transparent support sheet 241 absorbs a minimum amount of heat from the infrared electro-magnetic radiation of the first infrared source 251. Several examples of material suitable for fabricating the transparent support sheet 241 include quartz, silicon carbide as well as various ceramic materials.

Figure 10:
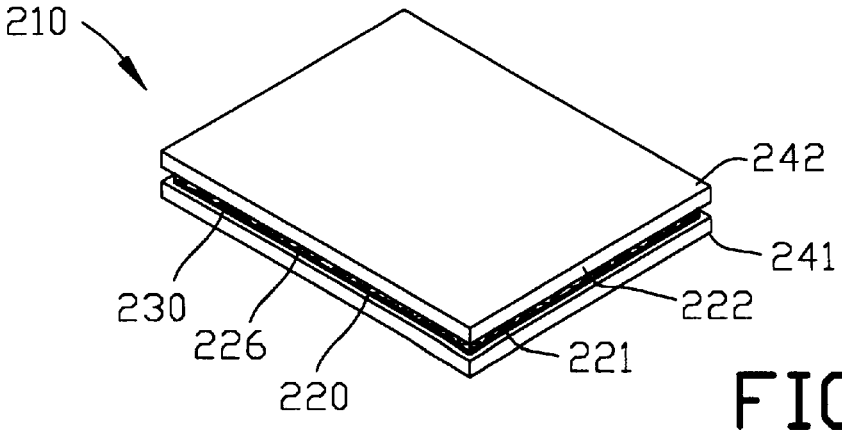
FIG. 10 is an isometric view of the apparatus of FIG. 9 illustrating the web being compressed by a transparent compression sheet.

FIG. 10 is an isometric view of the apparatus 210 of FIG. 9 illustrating the web 220 being compressed by a transparent compression sheet 242. The transparent compression sheet 242 is fabricated from a material being transparent to the infrared electromagnetic radiation of the second infrared source 252. The transparent compression sheet 242 absorbs a minimum amount of heat from the infrared electromagnetic radiation of the second infrared source 252. Several examples of material suitable for fabricating the transparent compression sheet 242 include quartz, silicon carbide as well as various ceramic materials.

The transparent compression sheet 242 compress the web 220 from an uncompressed condition 224 of the web 220 as shown in FIGS. 8 and 9 to a compressed condition 226 of the web 220 as shown in FIG. 10. The compressed condition 226 of the web 220 has a reduced thickness relative to the uncompressed condition 224 of the web 220.

Figure 11:
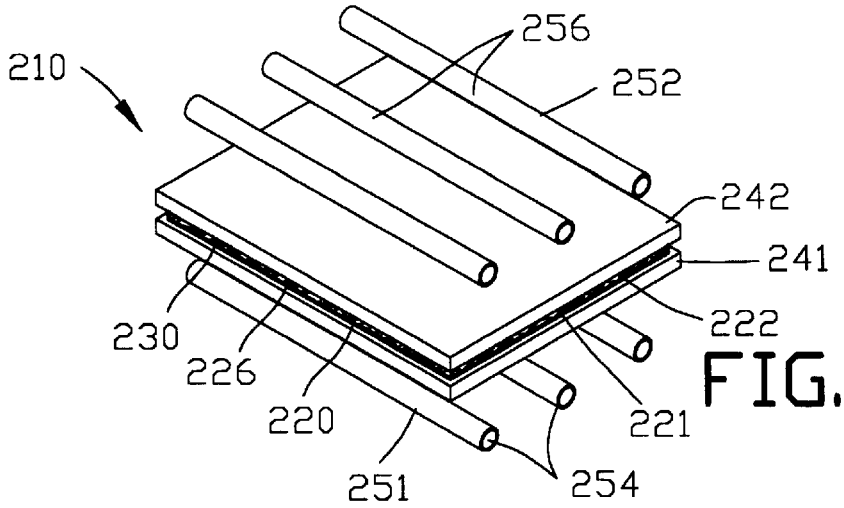
FIG. 11 is an isometric view of the apparatus of FIG. 10 illustrating the transparent sheets and the web being located between a first and a second source of irradiation.

FIG. 11 is an isometric view of the apparatus of FIG. 10 illustrating the transparent sheets 241 and 242 and the web 220 being located between a first and a second source of irradiation 251 and 252. Each of the first and second light source 251 and 252 comprise a plurality of infrared lamps 254 and 256. Preferably, the transparent sheets 241 and 242 and the web 220 are moved between the first and second sources of irradiation 251 and 252 by an automatic operation.

Figure 12:
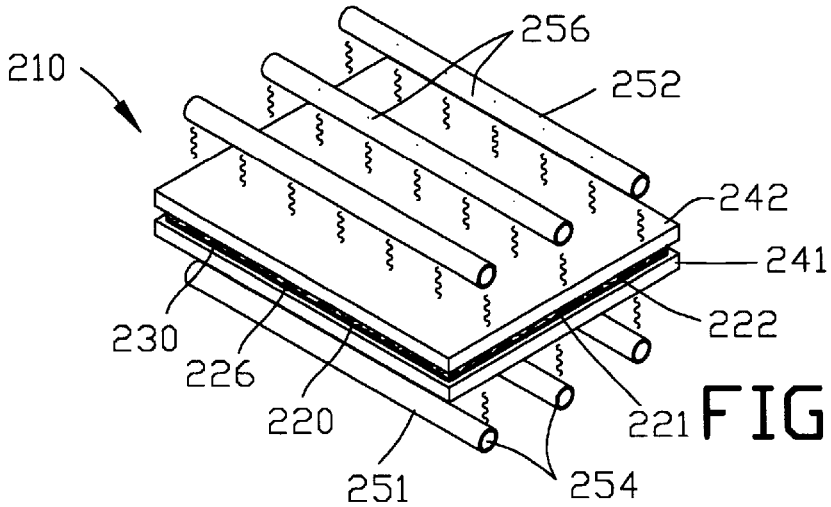
FIG. 12 is an isometric view of the apparatus of FIG. 11 illustrating the sintering of the web by the source of irradiation.

FIG. 12 is an isometric view of the apparatus 210 of FIG. 11 illustrating the sintering of the web 220 by the first and a second source of irradiation 251 and 252. Preferably, the first and second infrared sources 251 and 252 emit infrared electromagnetic radiation having a wavelength greater than 700 nm. The infrared electromagnetic radiation from the first and second infrared sources 251 and 252 is transmitted through the first and second transparent sheets 241 and 242 for irradiating the first and second sides 221 and 222 of the web 220.

The intensity of the first and second infrared sources 251 and 252 is adjusted to irradiate the web 220 with infrared energy for a period of time sufficient to sinter bond each of the elements 230 to adjacent elements 230 of the matrix randomly oriented elements 230. Preferably, the irradiating of the web 220 is accomplished in a controlled atmosphere. The first and second infrared sources 251 and 252 may be enclosed for providing a controlled atmosphere for the sintering process. The web 220 may be irradiated within a vacuum, a reactive atmosphere or a non-reactive atmosphere. In one example of the process, the web 220 is irradiated within a reducing atmosphere such as hydrogen.

Figure 13:
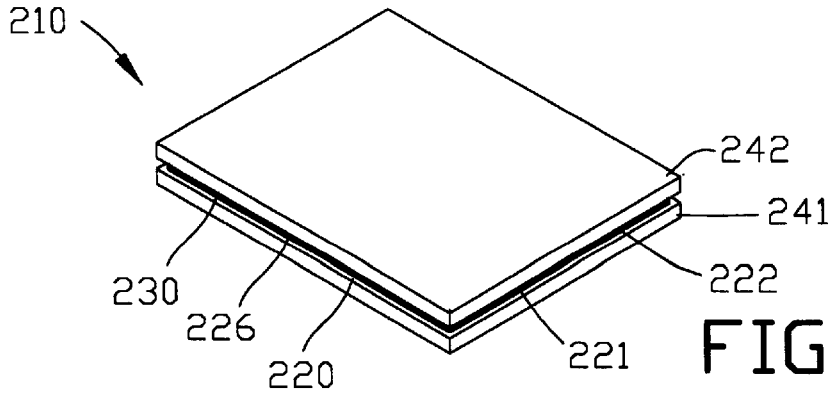
FIG. 13 is an isometric view of the apparatus of FIG. 12 illustrating the transparent sheets and the sintered elements being removed from the first and the second sources of irradiation.

FIG. 13 is an isometric view of the apparatus 210 of FIG. 12 illustrating the transparent sheets 241 and 242 and the sintered elements 230 being removed from the first and second sources of irradiation 251 and 252. Since the transparent sheets 241 and 242 absorb a minimum amount of heat from the first and second infrared source 251 and 252, the sintered elements 130 rapidly cools after being irradiated by the first and second infrared sources 251 and 252.

Figure 14:
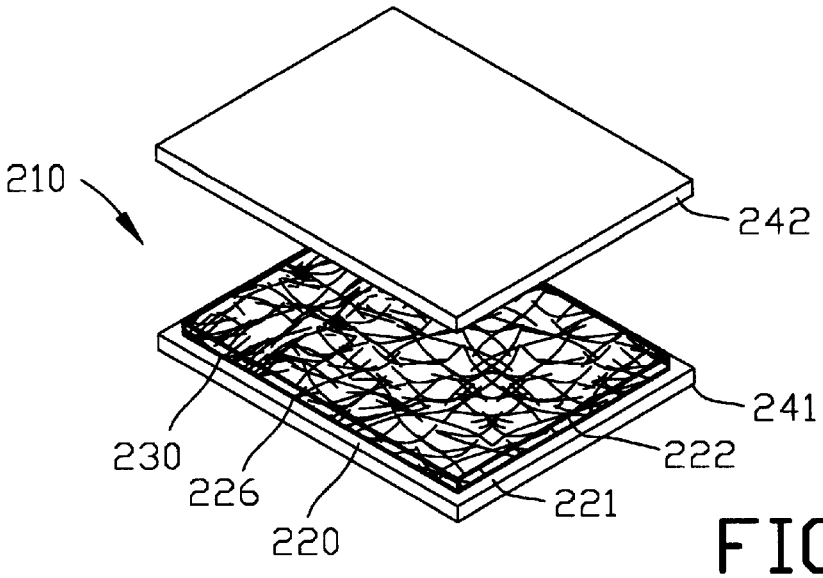
FIG. 14 is an isometric view of the apparatus of FIG. 13 illustrating the transparent compression sheet being removed from the sintered elements.

FIG. 14 is an isometric view of the apparatus 210 of FIG. 13 illustrating the transparent compression sheet 242 being removed from the sintered web 220. Preferably, the transparent sheets 241 and 242 and the sintered elements 230 are moved away from the first and second sources of irradiation 251 and 252 by an automatic operation.

Figure 15:
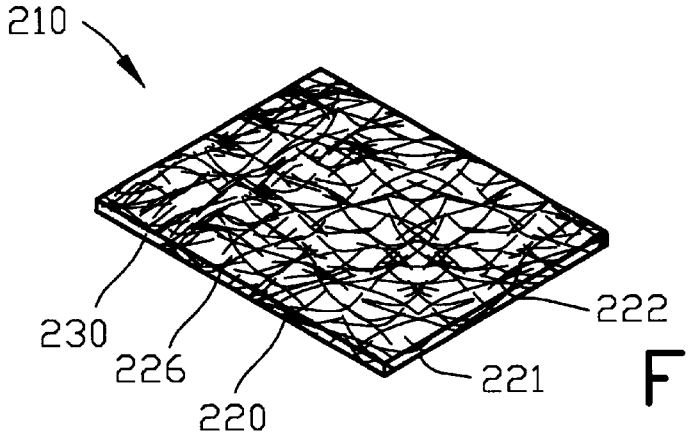
FIG. 15 is an isometric view of the apparatus of FIG. 14 illustrating the completed sintered elements.

FIG. 15 is an isometric view of the apparatus 210 of FIG. 14 illustrating the completed sintered elements 230. The completed sintered elements 230 may be used for various purposes such as filter media, catalyst carrier, a battery plate or any other suitable purpose.

Figure 16:
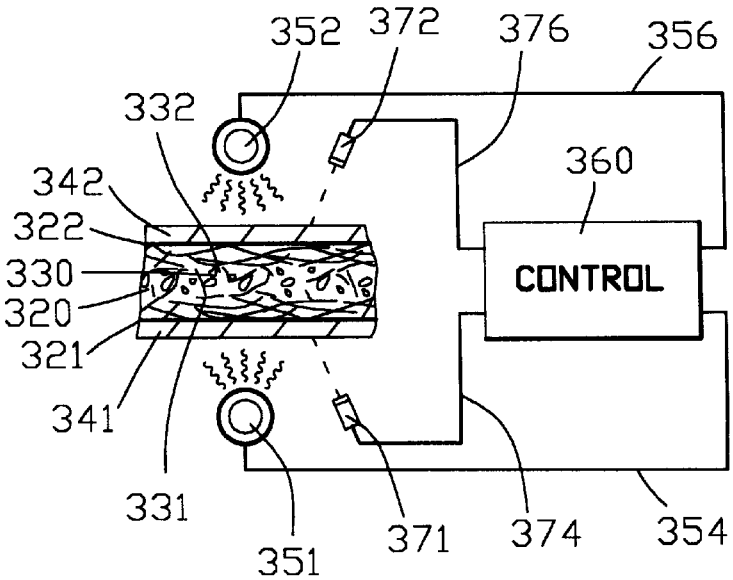
FIG. 16 is an isometric view of a fourth embodiment of the present invention illustrating an apparatus for sintering a web of randomly oriented elements utilizing an improved control for the sources of irradiation.

FIG. 16 is an isometric view of a fourth embodiment of the present invention illustrating an apparatus 310 for sintering a web 320 of randomly oriented elements 330 utilizing an improved control 360 for controlling the first and second sources of irradiation 351 and 352. The web 320 of the elements 330 defines a first side 321 and an opposing second side 322.

In this example, the matrix randomly oriented elements 330 may comprise a composite of a plurality of first elements 331 and a plurality of second elements 332. The plurality of first elements 331 may be metallic fibers whereas each of the second elements 332 may be non-metallic elements. The plurality of metallic elements 331 form the matrix of the randomly oriented elements for entrapping the plurality of non-metallic elements 332 therein. The plurality of metallic elements 331 form a matrix of the randomly oriented elements disposed on opposed sides of the plurality of non-metallic elements 332.

The web 320 is placed upon a transparent support sheet 341 and is compressed by a transparent compression sheet 342. The transparent sheets 341 and 342 are fabricated from a material being transparent to the infrared electromagnetic radiation of the first and second infrared sources 351 and 352 to absorb a minimum amount of heat from the infrared electromagnetic radiation.

The first and second sources of irradiation 351 and 352 receive operating power from the control 360 through electrical connectors 354 and 356. The first and second infrared sources 351 and 352 emit infrared electromagnetic radiation that is transmitted through the first and second transparent sheets 341 and 342 for irradiating the first and second sides 321 and 322 of the web 320.

A first and a second optical pyrometer 371 and 372 sense the temperature of the first and second sides 321 and 322 of the web 320. The first and second optical pyrometers 371 and 372 apply an input to the control 360 through electrical connectors 374 and 376.

The control 360 adjusts the intensity of the first and second infrared sources 351 and 352 to irradiate the web 320 with infrared energy for an intensity and a period of time sufficient to sinter bond each of the elements 330 to adjacent elements 330 of the matrix randomly oriented elements 230. As will be described in greater detail hereinafter, the intensity and the duration of the first and second infrared sources 351 and 352 may be controlled by the control in accordance with a preestablished program or cycle. Preferably, the irradiating of the web 220 is accomplished in a controlled atmosphere.

The transparent sheets 341 and 342 absorb a minimum amount of heat from the first and second infrared source 351 and 352. Accordingly, the web 320 may be rapidly heated by the first W and second infrared sources 351 and 352. In addition, the web 320 rapidly cools upon termination of the irradiation by the first and second infrared source 351 and 352.

Typically, the web 320 is compressed to a thickness of 0.125 inches to 0.25 inches. The web 320 is highly porous allowing the irradiation from the first and second infrared source 351 and 352 to penetrate into the web 320 from the first and the second sides 321 and 322. The temperature sensed by the first and second optical pyrometers 371 and 372 is an accurate representation of the temperature of the web 320.

The web 320 is shown as a composite having a plurality of first elements 331 and a plurality of second elements 332. The plurality of first elements 331 may be sinterable metal fibers whereas the plurality of second elements 332 may be non-sinterable ceramics. The irradiation from the first and second infrared source 351 and 352 seals the plurality of non-sinterable ceramics 332 within the plurality of sinterable metal fibers 331. The proper selection of the frequency of the irradiation from the first and second infrared source 351 and 352 may selectively sinter the outer layers of the sinterable metal fibers 331 with the non-sinterable ceramics 332 interleaved therebetween. Further, metal fibers 331 may be mixed with the ceramic fibers 332 for creating a matrix of sintered metal fibers 331 with the non-sintered ceramic fibers 332 interspaced and mechanically locked therein.

The frequency of the irradiation from the infrared sources 351 and 352 may be chosen to be selectively absorbed by the plurality of first elements 331 and to be selectively reflected or transmitted by the plurality of second elements 332. The frequency of the irradiation from the infrared sources 351 and 352 may be chosen to rapidly sinter metal fibers 331 without deteriorating the non-sinterable ceramics 332. For example, the frequency of the irradiation may be chosen to rapidly sinter metal fibers 331 without poisoning a non-sinterable catalyst 332 entrapped within the metal fibers 331.

Figure 17:
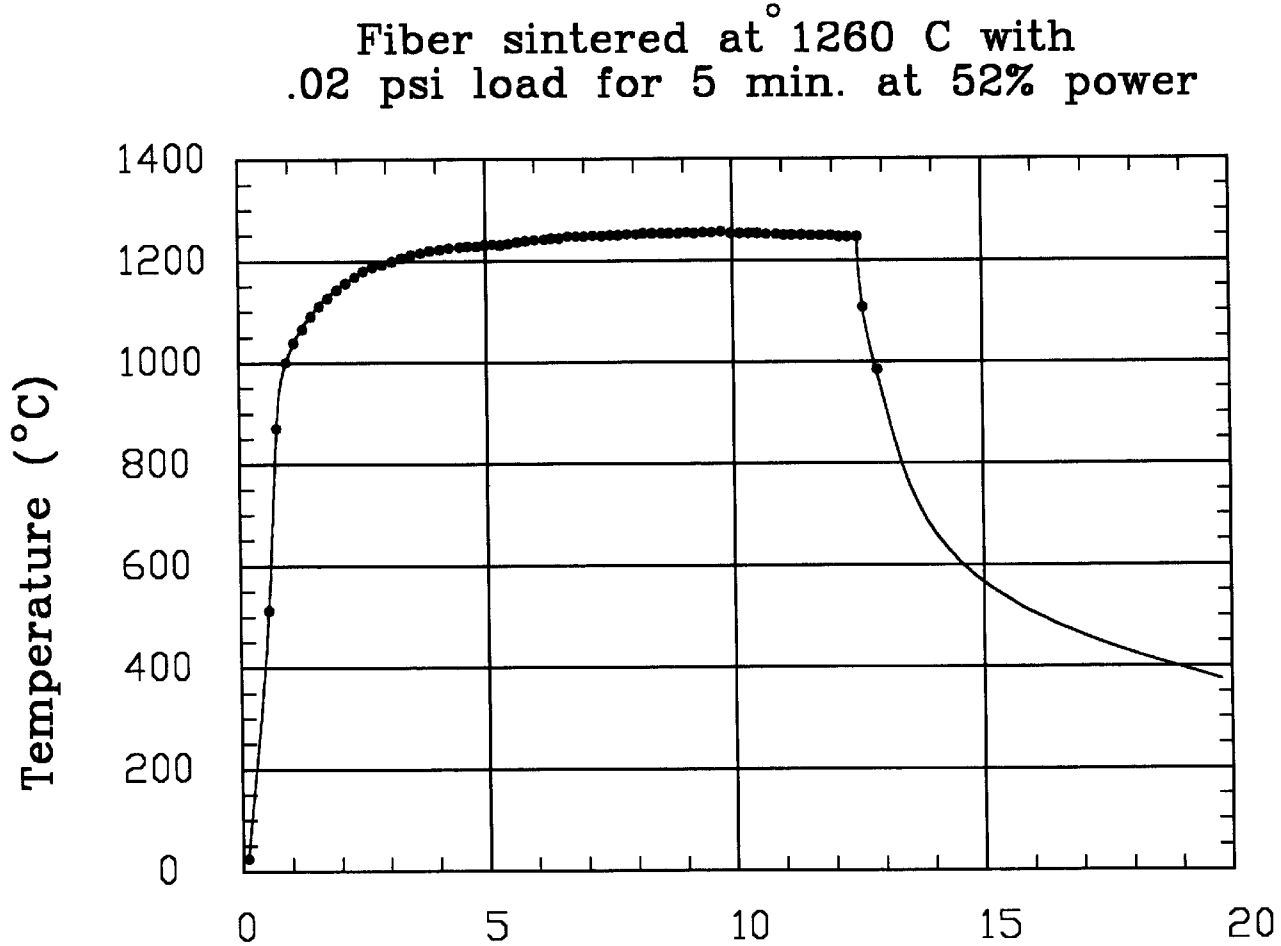
FIG. 17 is a graph of temperature as a function of time illustrating an example of the control of the intensity of the first and second infrared sources irradiating the web.

FIG. 17 is a graph of temperature as a function of time illustrating an example of the control of the intensity of the first and second infrared sources 351 and 352 irradiating the web 320 in FIG. 16. The curve reveals a rapid rise in temperature of the web 320 to 1000° C. in a period less than one minute. The web 320 reaches the soaking temperature of 1260° C. in less than five minutes. The web 320 is subjected to the soaking temperature for a period of five minutes and then rapidly cools in a matter of minutes as shown in FIG. 17. The period for cooling of the air and furnace in a conventional sintering furnace is on the order of hours. The apparatus and method of the present invention provides efficiencies over 60% as compared to efficiencies of 25% for prior art convection sintering processes.

The apparatus and method of sintering the matrix of fibers by infrared heating has many advantages over the prior art methods of sintering. The apparatus and method of the present invention is based on absorption whereas the prior art methods of sintering is based on convection. This advantages of the present invention over the prior art methods of sintering results in a smaller standard deviation.

In addition, the infrared heating of the present invention is a non-contact and inherently clean heating process. The convection and conduction heating processes of the prior art require contact with the web.

Furthermore, the infrared heating provides high heat fluxes resulting in fast heating of the web. Temperature rises of 50–300° C./second are possible through the use of infrared heating methods.

Moreover, the apparatus and method of the present invention provides rapid cooling due to the fact the heat is concentrated or focused onto the web. The convection heating of the prior art apparatuses require the heating of a gas in a furnace.

Furthermore, the heating of the web may be precisely controlled by automated means. The heating of the web may be established in accordance with a preestablished program or cycle.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. The method of sintering a web of elements, comprising:

simultaneously compressing and irradiating the web containing elements with infrared energy for a period of time sufficient to sinter bond each of the elements to adjacent elements within a matrix of randomly oriented elements.

2. The method of sintering a web of elements as set forth in claim 1, wherein each of the elements of the matrix of randomly oriented elements is a metallic fiber.

3. The method of sintering a web of elements as set forth in claim 1, wherein each of the elements of the matrix of randomly oriented elements is a stainless steel fiber.

4. The method of sintering a web of elements as set forth in claim 1, wherein the elements of the matrix of randomly oriented elements comprises a plurality of first metallic fibers and a plurality of second metallic fibers.

5. The method of sintering a web of elements as set forth in claim 1, wherein the matrix of randomly oriented elements comprises a composite of a plurality of first elements and a plurality of second elements.

6. The method of sintering a web of elements as set forth in claim 1, wherein the matrix of randomly oriented elements comprises a composite of a plurality of first elements and a plurality of second elements; and each of said plurality of first elements being a metallic fiber and each of said second elements being a non-metallic particle.

7. The method of sintering a web of elements as set forth in claim 1, wherein the matrix of randomly oriented elements comprises a plurality of metallic elements and a plurality of non-metallic elements; and said plurality of metallic elements forming the matrix of the randomly oriented elements for entrapping said plurality of non-metallic elements therein.

8. The method of sintering a web of elements as set forth in claim 1, wherein the matrix of randomly oriented elements comprises a plurality of metallic elements and a plurality of non-metallic elements; and said plurality of metallic elements forming the matrix of the randomly oriented elements disposed on opposed sides of said plurality of non-metallic elements.

9. The method of sintering a web of elements as set forth in claim 1, wherein the matrix of randomly oriented elements comprises a plurality of metallic elements and a plurality of non-metallic elements; and the step of compressing and irradiating the web includes irradiating the web with infrared radiation having a wavelength for preferentially heating said plurality of metallic elements relative to said plurality of non-metallic elements.

10. The method of sintering a web of elements as set forth in claim 1, wherein the step of irradiating the web includes irradiating the web with infrared radiation having a wavelength greater than 700 nm angstroms.

11. The method of sintering a web of elements as set forth in claim 1, wherein the step of irradiating the web includes monitoring the temperature of the web; and controlling the output of the infrared radiation for irradiating the web in accordance with a predetermined standard.

12. The method of sintering a web of elements as set forth in claim 1, wherein the step of irradiating the web includes monitoring the temperature of the web; and controlling the output of the infrared radiation for irradiating the web in accordance with the Arrhenius formula.

13. The method of sintering a web of elements as set forth in claim 1, wherein the step of irradiating the web includes simultaneously irradiating the web from opposed first and second sides of the web.

14. The method of sintering a web of elements as set forth in claim 1, wherein the step of irradiating the web includes moving the web past the source of infrared radiation.

15. The method of sintering a web of elements as set forth in claim 1, wherein the step of irradiating the web includes irradiating the web in a vacuum.

16. The method of sintering a web of elements as set forth in claim 1, wherein the step of irradiating the web includes irradiating the web in a reactive atmosphere.

17. The method of sintering a web of elements as set forth in claim 1, wherein the step of irradiating the web includes irradiating the web in a non-reactive atmosphere.

18. The method of sintering a web of elements as set forth in claim 1, wherein the step of irradiating the web includes irradiating the web in a hydrogen atmosphere.

19. The method of forming a sintered web of fibers, comprising:

arranging the fibers into a matrix randomly oriented fibers to form a web;

simultaneously compressing and irradiating the web with infrared energy for a period of time sufficient to sinter bond each of the fibers to adjacent fibers within the matrix randomly oriented fibers.

20. The method of forming a sintered web of fibers as set forth in claim 19, wherein the step of simultaneously compressing and irradiating the web includes rolling the web between a first and a second roller transparent to infrared energy for at least partially compressing the web and irradiating the web through the first and second transparent rollers onto opposed first and second sides of the web.

21. The method of forming a sintered web of fibers as set forth in claim 19, wherein the step of simultaneously compressing and irradiating the web includes compressing the web between a first and a second compression sheet transparent to infrared energy for at least partially compressing the web and irradiating the web through the first and second compression sheets onto opposed first and second sides of the web.

22. The method of forming a sintered web of fibers as set forth in claim 19, wherein the step of simultaneously compressing and irradiating the web includes compressing the web between a first and a second roller transparent to infrared energy for at least partially compressing the web and irradiating the web through the first and second rollers from a source of infrared energy positioned internal the first and second rollers.

23. The method of forming a sintered web of fibers as set forth in claim 19, wherein the step of compressing and irradiating the web includes compressing the web between a first and a second infrared transparent material for at least partially compressing the web; and irradiating the web through the first and second infrared transparent materials from a source of radiation positioned on opposed sides of the first and second infrared transparent materials.

24. The method of forming a sintered web of fibers as set forth in claim 18, wherein the step of irradiating the web includes irradiating the web in a vacuum.

25. The method of forming a sintered web of fibers as set forth in claim 19, wherein the step of irradiating the web includes irradiating the web in a reactive atmosphere.

26. The method of forming a sintered web of fibers as set forth in claim 19, wherein the step of irradiating the web includes irradiating the web in a non-reactive atmosphere.

27. The method of forming a sintered web of fibers as set forth in claim 19, wherein the step of irradiating the web includes irradiating the web in a hydrogen atmosphere.

28. The method of sintering a web of elements, comprising:

compressing the web with a compression material transparent to infrared energy; and simultaneously irradiating the web with infrared energy passing through the compression material transparent energy for a period of time sufficient to sinter bond each of the elements to adjacent elements within the web.

29. The method of sintering a web of elements as set forth in claim 1, including the step of compressing the web prior to irradiating the web with infrared energy.

* * * * *

UNITED STATES PATENT AND TRADEMARK OFFICE

CERTIFICATE OF CORRECTION

PATENT NO. : 6,200,523 B1
DATED : March 13, 2001
INVENTOR(S) : Quick et al.

It is certified that error appears in the above-identified patent and that said Letters Patent is hereby corrected as shown below:

Column 9,
Line 16, after first delete "W".

Column 12,
Line 31, claim 24, line 2, delete "18" and insert therefore -- 19 --.

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*